United States Patent [19]

Fryer

[11] 4,208,565

[45] Jun. 17, 1980

[54] WELDING MACHINE FOR BANDING MATERIAL

[75] Inventor: George R. Fryer, Ansonia, Conn.

[73] Assignee: Fryer Corporation, Oxford, Conn.

[21] Appl. No.: 860,873

[22] Filed: Dec. 15, 1977

[51] Int. Cl.[2] ..... B23K 11/00

[52] U.S. Cl. ..... 219/78.15; 219/56

[58] Field of Search ..... 219/56, 57, 58, 78.15; 228/103, 104

[56] References Cited

U.S. PATENT DOCUMENTS

| | | | |
|---|---|---|---|
| 438,657 | 10/1890 | Thomson | 219/57 |
| 3,621,176 | 11/1971 | Valente | 219/57 |
| 3,634,930 | 1/1972 | Cranston | 228/103 X |
| 3,767,885 | 10/1973 | Fryer | 219/56 |

OTHER PUBLICATIONS

Pewick "Device for Testing the Adherence of Circuit Elements to a Substrate" West. Elec. Tech. Digest #37, 1/75, p. 21.

*Primary Examiner*—E. A. Goldberg
*Attorney, Agent, or Firm*—DeLio and Montgomery

[57] ABSTRACT

This specification discloses a wire banding method and machine, which comprises a base member, a circular guideway and wire feeding and tensioning means. Wire is fed across the base and past an article to be bound and then around the guideway until the leading edge thereof strikes a stop. At this time, clamping means on a first member on the base clamps and holds the leading end of the wire. Then the feeding means is reversed to tension the wire about the article. At the end of the tensioning step a second member on the base clamps the wire and the wire is severed prior to welding, then during the welding operation means are provided to prevent the welding current from damaging the articles being banded, then after welding the ends of the wire band, the weld is tensioned to check the integrity thereof.

9 Claims, 18 Drawing Figures

L1
L2
L3
L4
L5
L6
L7
L8
L9
L10
L11
SS
ST
TT1
ST1
ST2
CR3
TA
LS3
S3
TA1
TT3
TT
LS2
90
TB1
S5
T1
118
117
CR1
CR
B
CR2
S1
TB
TB2
TC1
S6
TC
TB3
S2
TT4
TT2
S4
LS1
118
WELDER
45
45a

WELDING MACHINE FOR BANDING MATERIAL

This invention relates to banding machines and banding methods, and more particularly relates to such machines and methods where the ends of a band are welded together to form an endless band.

In such banding operations, wire or flat strap is drawn from a supply, looped about objects to be banded (tensioned) and the loop is severed from the supply, and the ends are butt or side welded together to form the band.

One type of banding apparatus and method is disclosed in U.S. Pat. No. 3,767,385. That patent discloses and claims an apparatus and a method of tying objects from banding wire or flat strap pulled from a source thereof and passed about the object, whose one end is clamped with a welding electrode while the wire is tensioned and clamped intermediate the ends with another electrode laterally displaced from the first electrode. Then the wire is severed adjacent the second electrode, the ends are moved toward each other and a welding current is initiated as the ends are moved into engagement.

The apparatus described has adequately performed, however, it has been determined that certain improvements could be made in the overall method and apparatus for severing the wire, eliminating the possibility of damage to the banded articles due to the welding current, and testing the integrity of the weld. The present invention provides an improvement in the banding method and apparatus described in U.S. Pat. No. 3,767,885 and may be embodied in many other operations where articles are banded by welding ends of a metallic loop.

The present apparatus and method alleviate potential problems by providing a wire severing means which moves out of the welding area after severing the wire prior to welding, provides a tensile check on the integrity of the weld, and also shunts any welding current which might tend to enter the articles banded.

An object of this invention is to provide a new and improved wire banding machine and method of the type wherein the band is tensioned about the articles and the ends of a wire loop are welded together.

Another object of the invention is to provide a wire banding machine and method of the type described where the integrity of the weld may be checked.

Another object of the invention is to provide apparatus and method, of the type described, for eliminating the possibility of the welding current damaging the articles to be banded.

Another object of the invention is to provide a new and improved banding wire severing means for weld banding apparatus.

The features of the invention which are believed to be novel are particularly set forth and distinctly claimed in the concluding portion of this specification. The invention, however, both as to its organization and operation, together with further objects and advantages thereof may best be appreciated by reference to the following detailed description taken in conjunction with the drawings, wherein:

Figure 1:
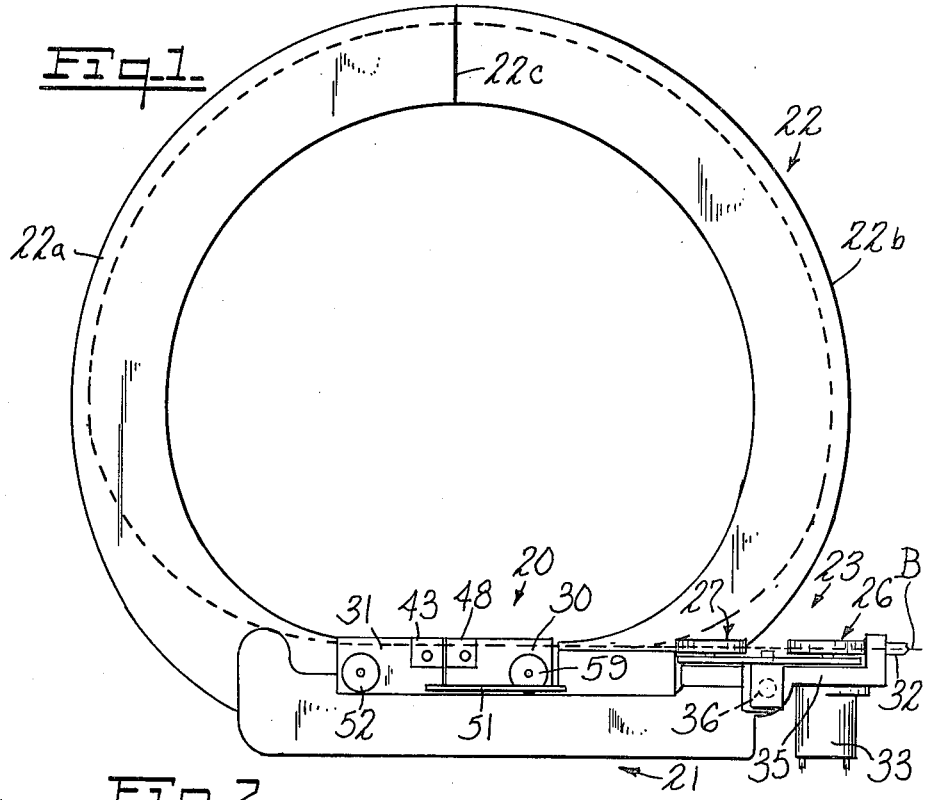
FIG. 1 is an elevation of a portion of a banding machine which embodies the invention.
Figure 2:
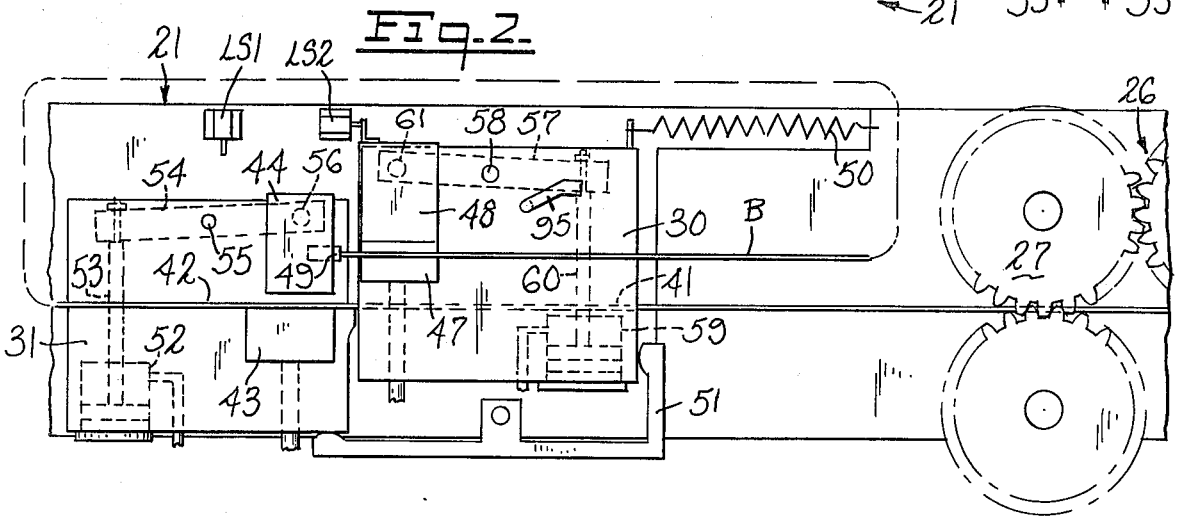
FIG. 2 is a plan view of the base of the machine of FIG. 1.

A machine 20 embodying the invention, as shown in FIGS. 1 and 2, comprises a base member 21 which rests on a pedestal (not shown). The base supports a guideway 22, for a wire B as it is drawn from a supply (not shown) through a feed mechanism 23. The guideway 22 may comprise sections *22a* and *22b* which pivot open and part at *22c* to permit some types of bundles (such as coils) to be inserted within guideway 22. The feed mechanism comprises drive roller pairs 26 and 27. Carried on base 21 for movement thereon are first and second members 30 and 31, hereinafter referred to as a nose slide and a tail slide, respectively.

The mechanism hereinafter described may better be appreciated with an outline of the operative steps thereof. The articles to be bound may comprise a plurality of rods, as hereinafter exemplified, which are inserted through the opening defined by guideway 22 and base 21, or inserted when guideway sections *22a* and *22b* are opened.

The wire B is fed through a sleeve 32 and guideways in members 30 and 31 about guideway 22 until it returns and the leading edge thereof strikes a contact indicating that a complete loop has been made. At this time a clamping means on nose slide 30 is actuated to hold the leading edge of the wire and the feed means is reversed to tension the wire about an object. At the end of the tensioning step, the wire is clamped in the tail slide 31. The slide 31 is moved transversely of base 20 severing the wire. Nose slide 30 is retracted slightly to permit alignment of the ends. The slide 30 is moved toward slide 31 and the ends of the wire are fused by welding. The banding loop is represented in several views partially in broken line.

Reference is now made to the drawings for a detailed description of the mechanism. The wire B passes through a sleeve 32 to a first and second sets of drive rollers or wheels 26 and 27 with gears thereon. The sleeve 32 is cut away intermediate the pairs of wheels 26 and 27, to provide engagement between the wheels and the wire. The wheel pairs 26 and 27 are driven by means of a hydraulic motor 33. Motor 33 drives one of wheels 26 which is geared to the other wheel and to one of wheels 27. The drive wheels of one side are mounted on a support 35 carried on the end of a support shaft 36. A spring (not shown) about shaft 36 urges the drive wheels on support 35 toward engagement with the wheels on the other side and thereby compressively engage the wire in the wheel grooves 39 and 40. This will compensate for possible different sizes of banding wire. The wheels are provided with grooves 39 and 40 of different size to accommodate various sizes of wire.

Figure 3:
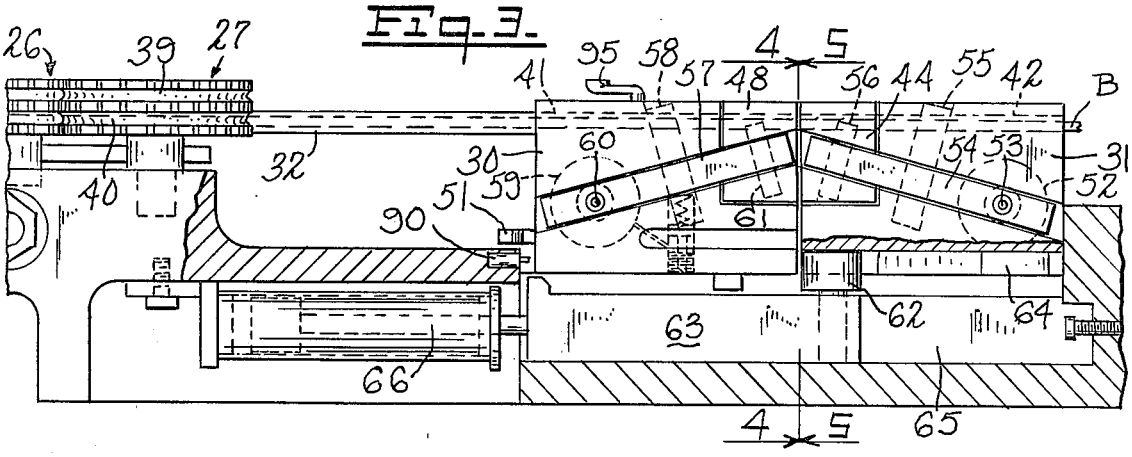
FIG. 3 is an enlarged view of a portion of the mechanism of FIG. 1, partly in section seen from the other side thereof.
Figure 4:
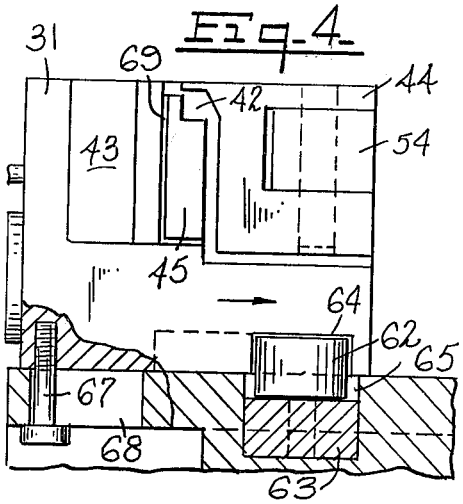
FIG. 4 is a view seen in the plane of lines 4—4 of FIG. 3.

The banding wire is fed through sleeve 32 into a passage 41 (FIG. 3) defined through nose slide 30 and through passage 42 defined through tail slide 31, between a stationary clamping member 43 and a movable clamping member 44 (FIG. 2). Stationary clamping member 43 also incorporates a suitably insulated welding electrode or contact 45 (FIG. 4).

Figure 5:
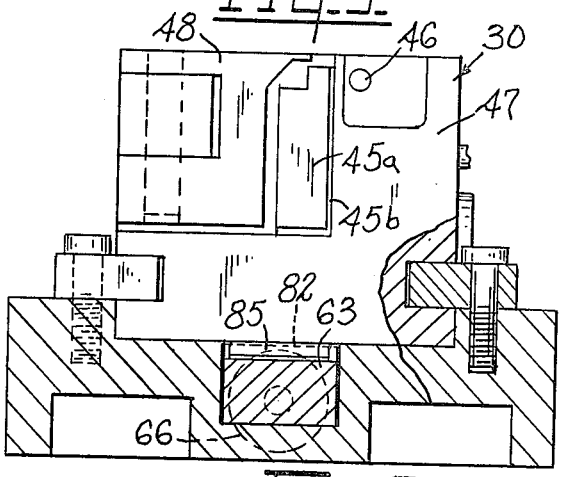
FIG. 5 is a view seen in the plane of lines 5—5 of FIG. 3.

The banding wire B is fed through passage 42 (FIG. 4) defined between clamping members 43 and 44 into guideway 22, about the guideway and into a passage 46 defined between a stationary clamping member 47 and a movable clamping member 48 (FIG. 5). The banding wire then proceeds until the leading edge thereof closes an electrical contact 49 on slide 31. This will commence a cycle of operation as hereinafter described. The stationary clamping member 47 includes the other welding electrode or contact member **45*a*** (FIG. 5).

Nose slide 30 is movable a slight distance under the influence of a spring 50 when tail slide 31 moves transversely across base 21 and allows a holding lever 51 to pivot slightly. Movement of tail slide 31 to a given position transversely of base 14 is sensed by a normally open limit switch LS1 (FIGS. 6 and 7), and movement of nose slide 30 to a complete welding position is sensed by a normally closed limit switch LS2, both on base 21. Movable clamping member 44 on tail slide 31 is actuated through a cylinder 52 carried in slide 31 and having a rod 53 which pivots a lever 54 at one end thereof about a pin 55 carried in slide 31. Referring to FIG. 3, lever 54 is attached to a pin 56 at the other end thereof. Pin 56 is carried in movable clamping member 44. In a similar manner, movable clamping member 48 on nose slide 30 is actuated through a lever 57 about a pivot pin 58 by a cylinder 59 (FIG. 2) having a rod 60 connected to one end of lever 57. Lever 57 is connected to clamping member 48 by means of a pin 61 carried in member 48.

The welding electrode or contact **45*a* is suitably insulated from slide 30 by insulation 45*b*. Additionally, the movable clamping member is insulated from slide 30 at the lower surface thereof (insulation not shown). The movable clamping member is preferably further insulated from slide 30 by a sleeve (not shown) about pin 61 and insulation between the surfaces thereof in proximity to slide 30 and lever 57. The electrode or contact 45 on tail slide 31 is the ground contact and need not be insulated from movable clamp 44**.

Figure 6:
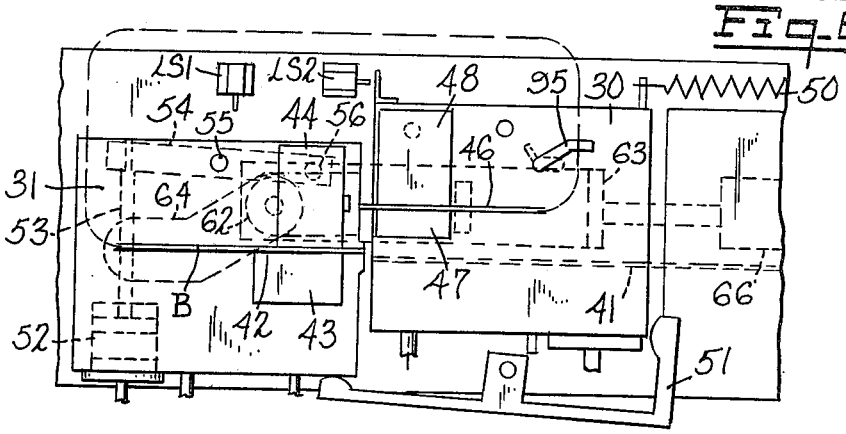
FIGS. 6 and 7 are plan views similar to FIG. 2, but showing various positions of the elements of the mechanism to exemplify the operation of the apparatus.
Figure 7:
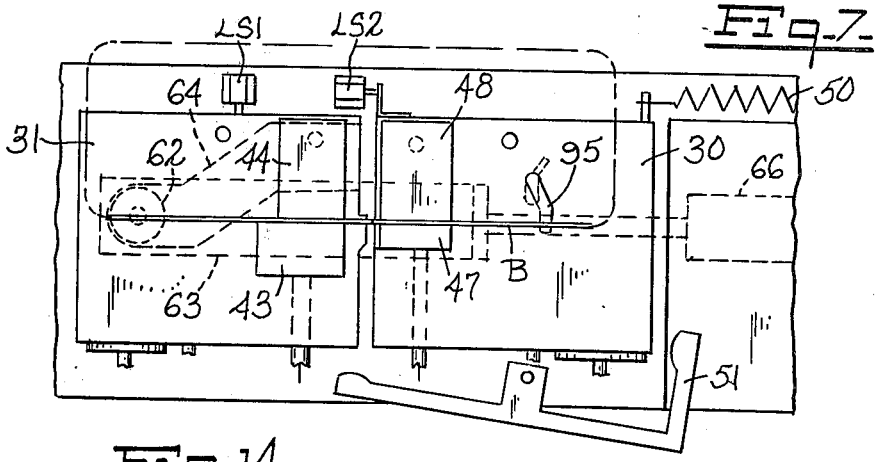

Tail slide 31 is moved transversely of base 23 by means of a cam roller 62 carried on a slide 63 (FIG. 4) and received in a cam slot 64 defined in the underside of tail slide 31 (FIGS. 6 and 7). Slide 63 is movable in a guideway 65 therefor in base 14. Slide 63 is actuated by a cylinder 66 carried on base 14 (FIG. 3). As shown in FIG. 4, tail slide 31 is secured to base 23 as by means of a plurality of bolts 67 which extend through elongated slots 68 in base 21. As further shown in FIG. 4, the stationary clamping member 43 which may include insulating member 69 and electrode 45 may be demounted and replaced as may be required through wear.

Figure 10:
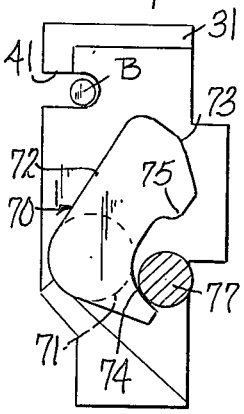
FIG. 10 is a view similar to FIG. 9, but showing the severing mechanism of FIG. 8 in an inoperative position.
Figure 8:
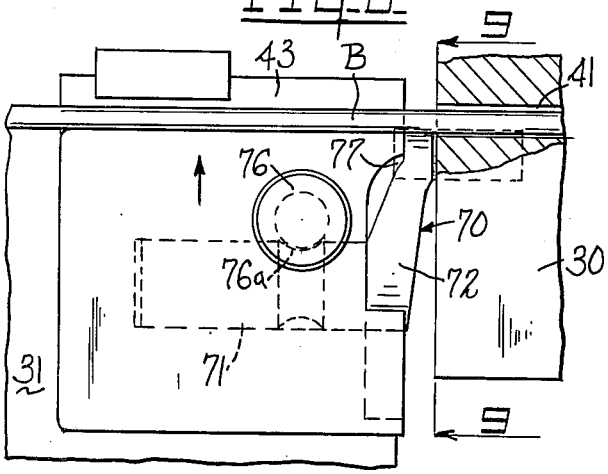
FIG. 8 is an enlarged plan view of a portion of FIG. 7 showing a wire severing mechanism.
Figure 9:
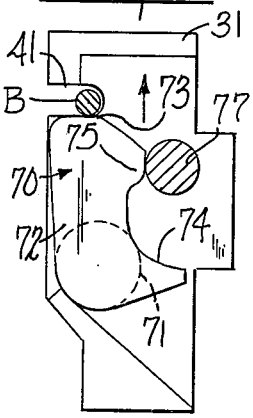
FIG. 9 is an end view of the apparatus seen in the plane of lines 9—9 of FIG. 8.

The apparatus as thus far described is the same as disclosed and claimed in U.S. Pat. No. 3,767,885. Referring to FIGS. 8–10, a wire cutting member 70 is pivotally mounted on clamping member 43. Cutting member 70 includes a shank portion 71 in member 43 and an arm portion 72 having a cutting edge 73 thereon. A cam portion 74 extends from member 70 and a second camming portion 75 extends from arm 72. A bolt 76 extends into a groove **76*a* in shank 71 to retain member 70 in member 43. A pin 77 carried by slide 30 cooperates with member 70**.

As slide 31 moves from the position of FIG. 6 toward the position of FIG. 7 to align the ends of the wire for welding, pin 77 acting on cam 74 positions arm 72 as shown in FIG. 9 to sever the wire from the supply. After severing, and prior to welding, cam 74 of member 70 contacts pin 77 and is pivoted downwardly from the area of weld. This protects the cutter from erosion or other damage from the heat of the weld. After the weld, when slide 31 is retracted to open the clamp, pin 77 will engage cam 75 and return arm 72 to a cutting position. At the time of welding (FIG. 4), after slide 31 is moved transversely by slide 63 and cam roller 62 in slot 64, a shoulder 82 (FIG. 12) on slide 63 engages a lug 85 on slide 30 and urges the ends of the wire into contact during the welding operation.

Figure 11:
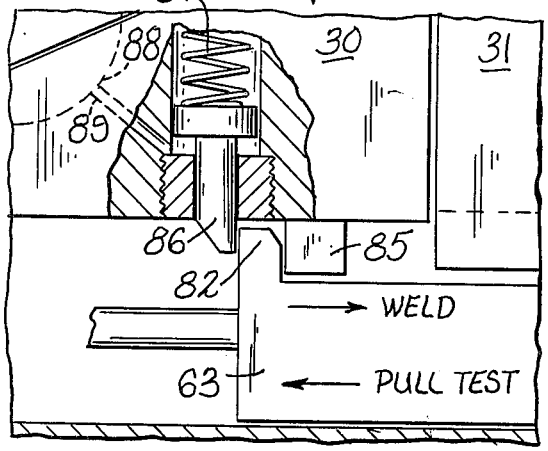
FIG. 11 is an enlarged view partially in section of a portion of FIG. 3.
Figure 12:
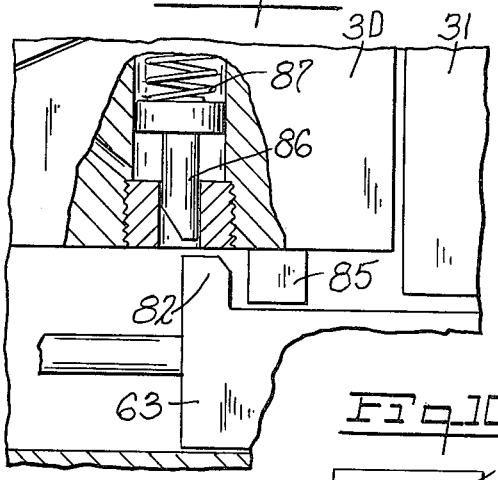
FIG. 12 is an enlarged view, partially in section, similar to FIG. 11, but showing another state of operation.

Means are provided to tension a weld and test the integrity thereof. Reference is now made to FIGS. 11 and 12. Slide 63 is shown in position with a shoulder 82 engaging a lug 85 on slide 30 and being engaged by a latch pin 86 biased downwardly from slide 30 by a spring 87. This condition exists during welding and a short cooling period thereafter. Thereafter, cylinder 66 (FIG. 3) is actuated to pull slide 63 toward a retract position (left as shown in FIGS. 3 and 11). Shoulder 82 acts through latch pin 86 on slide 30. Since the wire is still clamped in both slides, the force exerted on slide 30 creates tension at the weld point. The tensile test is maintained for a timed period, then hydraulic pressure is applied to the piston 88 of pin 86 through passage 89 in slide 30 to raise latch pin 86 and release slide 63.

If the tensile test should cause the weld to break, nose slide 30 will be pulled to the left by slide 63 and close an electrical contact shown as switch 90 in FIG. 3.

When this switch is closed, it signifies that a new banding cycle is to be initiated.

Figure 14:
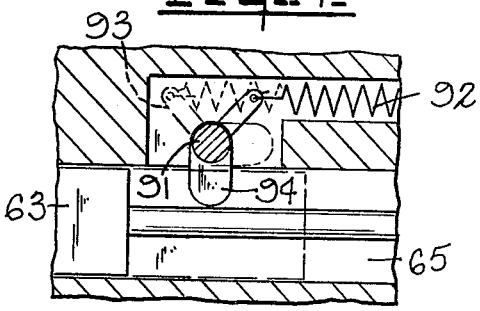
FIG. 14 is a view seen in the plane of lines 14—14 of FIG. 13.
Figure 13:
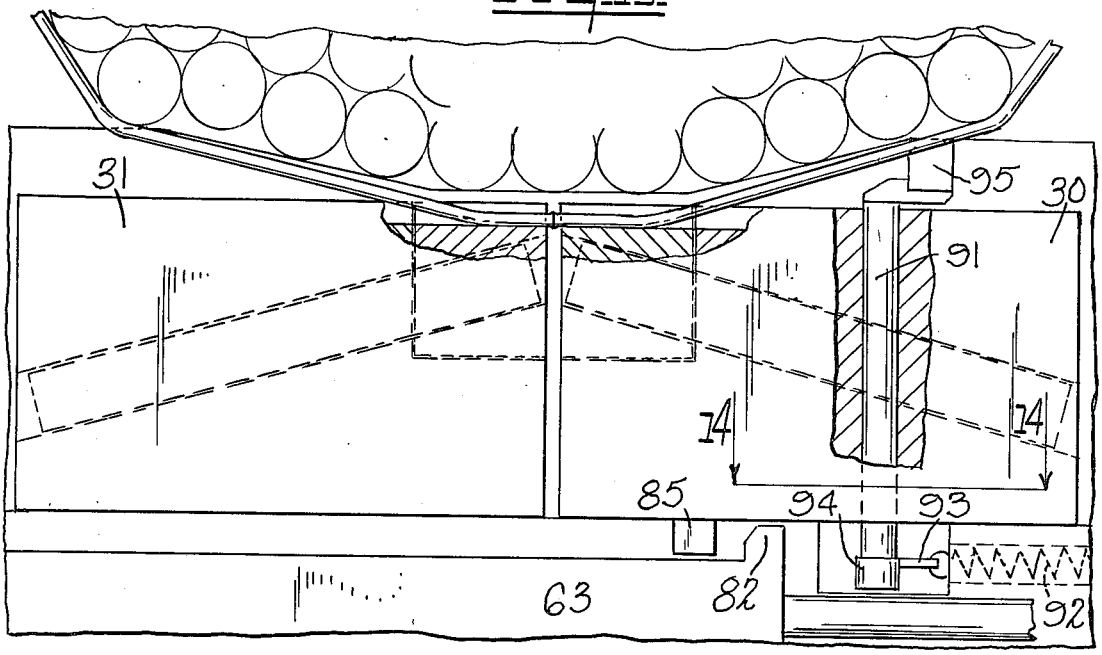
FIG. 13 is an enlarged view partially in section of a portion of FIG. 3.

Means are also provided to protect against the welding current moving in the wire band to any metal objects being banded and causing fusing therebetween. Reference is made to FIGS. 13 and 14. FIG. 13 exemplifies a band about a multiplicity of rods at the time of welding. Extending through slide 30 in the path of slide 63 is a pivot shaft 91 biased by a spring 92 acting on a lever arm 93 extending therefrom. A cam arm 94 extends from the shaft 91 at the bottom thereof. A contact arm 95 (FIG. 13) extends from the upper end of shaft 91 and is arranged to engage the wire B as slide 63 and cam roller 64 move slide 31 toward a welding position.

When this occurs, shaft 91 is pivoted by spring 92 to the position shown in full line in FIG. 14 and arm 95 engages the wire on the welding hot side relatively far removed from the point of weld and establishes a very high resistance path to ground. The point of contact of arm 95 on the wire is made prior to the first rod contacted on the hot welding side by the wire. In this manner, all welding current is shunted from the rods to be banded and no fusion of the band to the rods will occur. Contact arm 95 is only brought into contact with the wire when the ends of the wire are brought to a welding position. As this occurs, slide 63 moves past cam arm 94 of pivot shaft 91 and permits spring 92 to pivot shaft 91 to the position shown in FIGS. 7 and 13. As slide 63 is retracted, it engages arm 94 and pivots and holds shaft 91 in an inoperative position.

Figure 15:
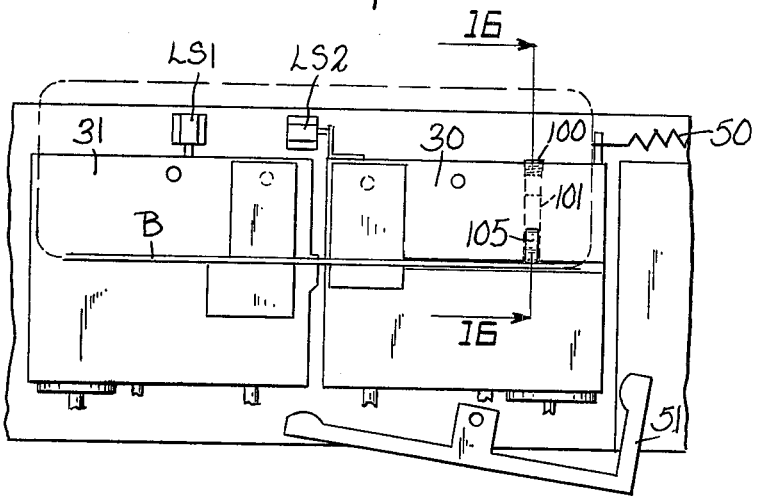
FIG. 15 is a view similar to FIG. 7, but showing an alternate welding current shunt arrangement.
Figure 16:
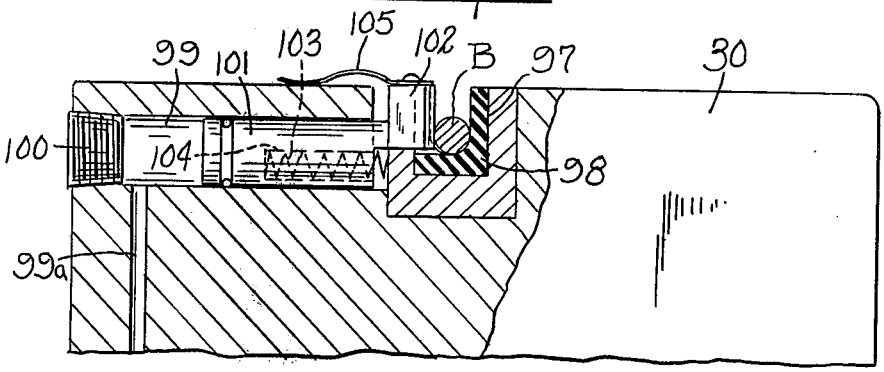
FIG. 16 is a view seen in the plane of lines 16—16 of FIG. 15.

FIGS. 15 and 16 exemplify another technique of shunting the welding current. A channel 97 for the wire B is defined in nose slide 30, and has an insulating liner 98. A bore 99 is defined in slide 30 and closed by a plug 100. A piston 101 having a contact head 102 is disposed in bore 99. A spring 103 received in a recess 104 in piston 101 acts to bias piston 101 and contact head 102 away from wire B. A grounding contact member 105 attached to contact head 102 also contacts slide 30. A portion of liner 98 is cut away to permit head 102 to contact wire B.

When fluid is supplied to bore 99 through a port **99*a*, piston 101 is moved to the right (as viewed in FIG. 15) and contacts wire B and grounds it through contact 105. This occurs when cylinder 66 is actuated to move cam slide 63 to position tail slide 31 for welding, and shunts the wire B to ground prior to contact of wire B with the stock to be banded. When welding is completed, fluid pressure in bore 99 is relieved, and spring 103 retracts piston 101 and contact head 102** from wire B.

Figure 17:
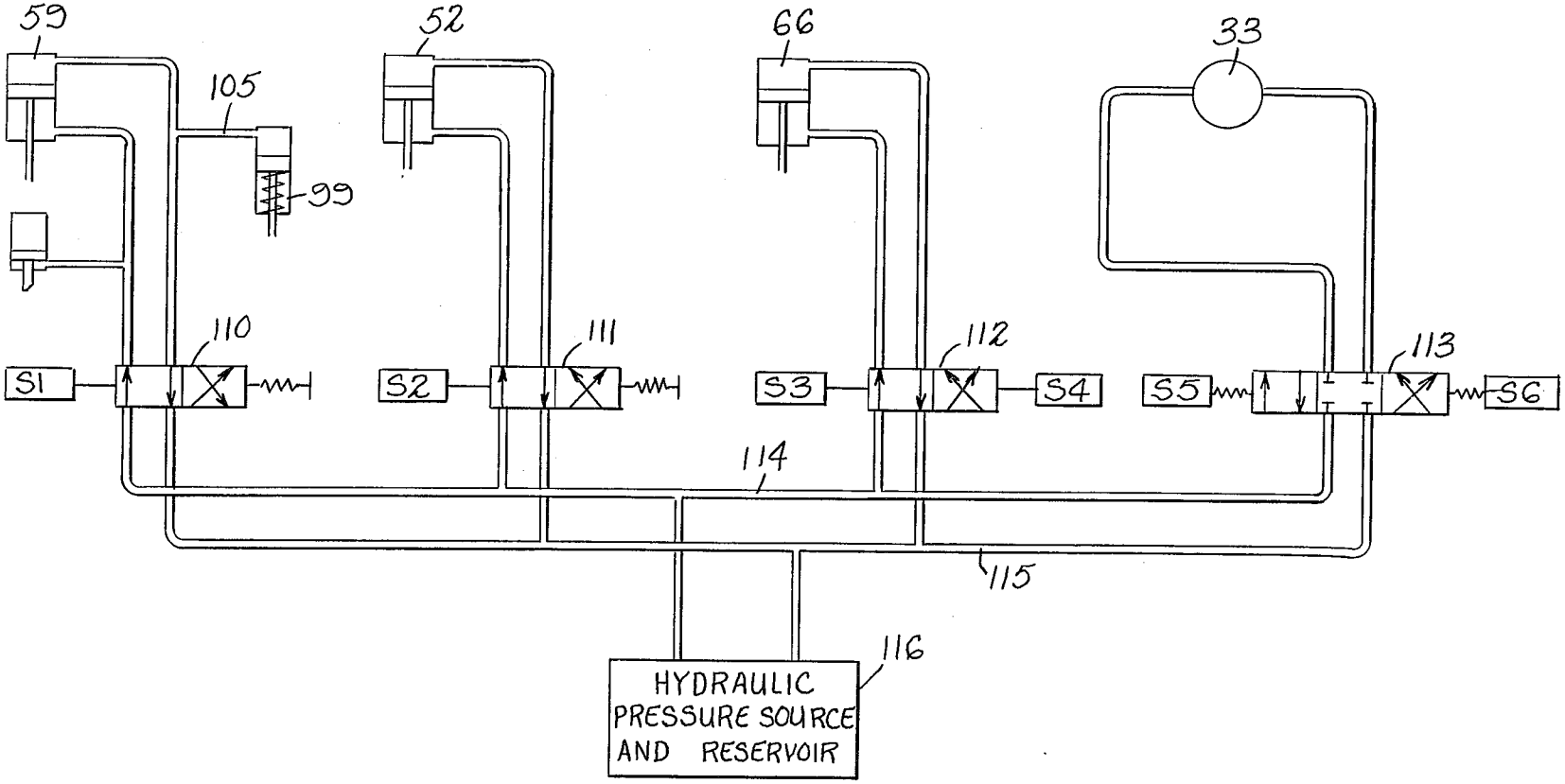
FIG. 17 is a schematic diagram of a hydraulic actuating system for a machine embodying the invention.

Reference is now made to FIG. 17 for a description of a hydraulic operating system. Cylinder 59, which operates the movable clamping member 48 on slide 30, is operated through a two-way valve 110 by a solenoid S1. A branch line leads to port 89 to lift pin 86 (FIG. 11) when clamp 48 is released. Cylinder 52, which operates the movable clamping member 44 on slide 31, is operated through a two-way valve 111 by a solenoid S2.

Cylinder 66, which moves slide 31 transversely of base 14, is operated by a two-way valve 112. Valve 112 is positioned to advance slide 63 (left-to-right as viewed in FIG. 7) when solenoid S4 is energized and retract slide 63 when solenoid S3 is energized.

Valve 113 is positioned to drive motor 33 in a feeding direction when solenoid S5 is energized and to drive motor 33 in the reverse direction to tension the wire when solenoid S6 is energized. Valve 113 also has a neutral position as shown.

The valves 110 - 113 and their controlled cylinders are connected to hydraulic pressure line 114 and return line 115. Hydraulic fluid is provided to line 114 from a pressure source 116 and returned to a reservoir in a well known manner. The hydraulic system includes the usual pressure regulating and relief valves, not shown. When clamp 48 is first actuated by cylinder 59, fluid is applied through port **99*a* to move shunt piston 101 (FIG. 16) into contact with the wire B. When clamp 48 is released the fluid in bore 99 bleeds off and spring 103 retracts the shunt. At this time fluid is also applied to bore 89 to lift latch pin 86 and permit slide 63** to be retracted.

Figure 18:
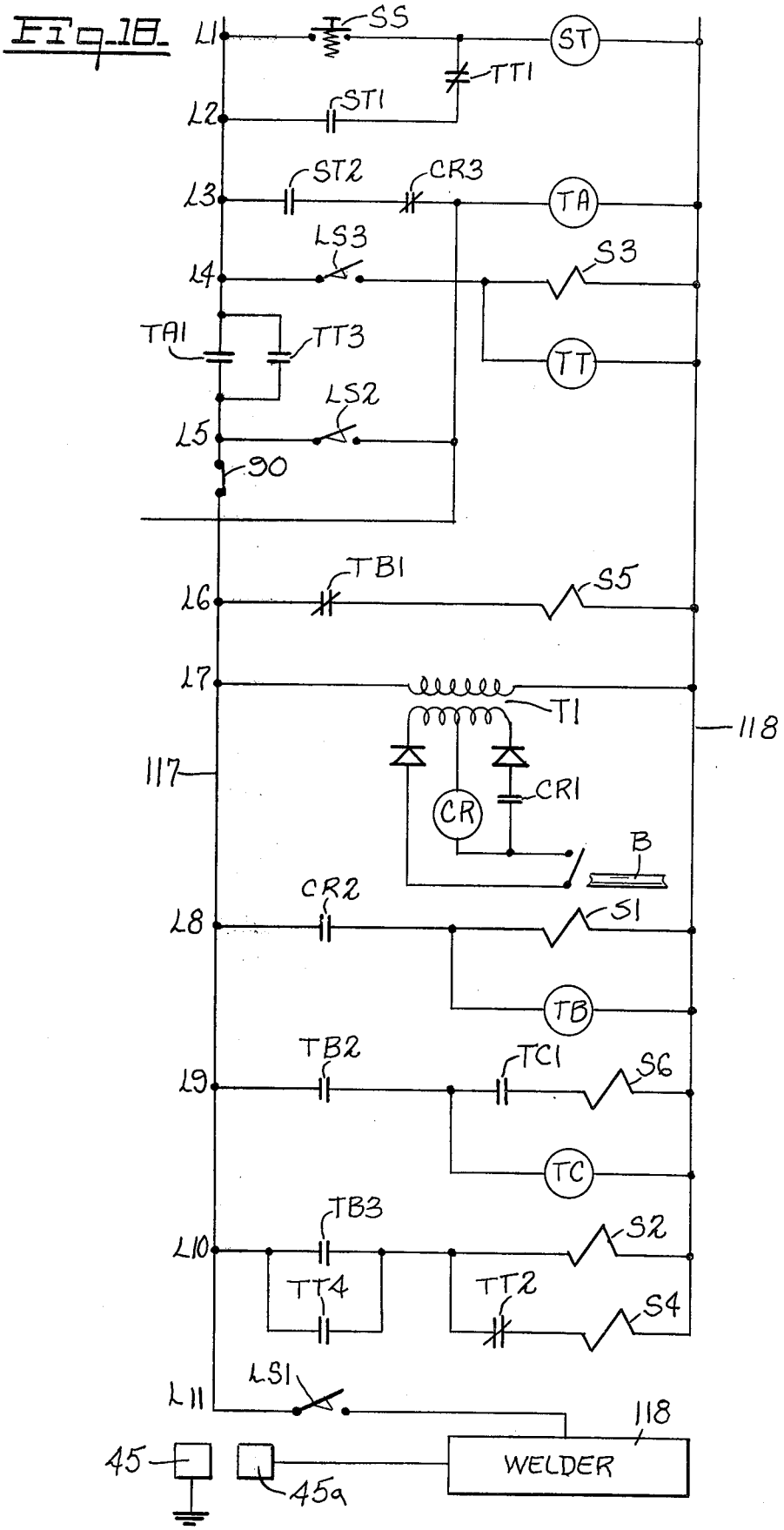
FIG. 18 is a schematic diagram of an electrical control system which may be utilized in controlling operation of the machine.

The method of banding and operation of the machine may best be appreciated by reference to the following discussion in conjunction with the schematic diagram of FIG. 18.

To commence a banding operation, an article such as a coil of wire or a bundle of rods or pipes is positioned within guideway 22. Then a start switch SS, FIG. 18, is momentarily closed to energize a relay ST in line L1 between bus lines 117 and 118. Relay ST is latched in by its contact ST1 in line L2.

When contact ST2 in line L3 is closed, a relay TA is energized and picks up its controlled contact TA1 in line 117 and is latched through normally closed limit switch LS2, line L5. The timing feature of relay TA is utilized to open its contacts a short time after it is de-energized.

When contact TA1 in line 117 is closed, solenoid S5 in line L6 is energized through a normally closed relay contact TB1. This positions valve 113 to cause motor 33 to feed wire B as previously described. The wire is then directed about guideway 22 and the leading end will strike switch 49. Transformer T1, being energized through the TA1 contact, energizes relay CR when the wire strikes contact switch 49 (FIG. 2). Relay CR latches itself by closing its contact CR1 and energizes solenoid S1 in line L9 through CR2. Solenoid S1 positions valve 110 to cause cylinder 59 to actuate clamp member 48 and clamp the leading edge of wire B in nose slide 30. At this time, hydraulic fluid is applied to port **99*a* to actuate shunt piston 101 (FIG. 16**).

At the same time, delay relay TB in line L9 is energized, and after a brief time delay, closes its contact TB2 in line L9 to energize relay TC which picks up its contact TC1 and energizes solenoid S6. Relay TB opens its contact TB1 in line L6 to de-energize solenoid S5. Motor 33 now reverses for a period of time determined by time delay relay TC. This time is set for a predetermined tensioning cycle. When relay TC times out, it opens its contact TC1 in line L9 to de-energize solenoid S6 and halt operation of motor 33 to tension the wire.

As relay TB times out, after relay TC is de-energized, it closes its normally open contact TB3 in line L10 to energize solenoids S2 and S4. When solenoid S2 is energized, clamping member 44 on slide 31 clamps the wire (FIG. 6). At the same time, solenoid S4 positions valve 112 to cause cylinder 66 to advance cam slide 63 and move tail slide 31 transversely of base 14 as shown in FIG. 7. As previously discussed in conjunction with FIGS. 8–10, the wire B is severed at this time.

As slide 31 moves toward limit switch LS1, it releases lever 51 to permit slide 30 to slightly retract (FIG. 7). When slide 31 closes limit switch LS1, the ends of the wire are aligned and a welder 119 is energized across electrodes or contact 45 and **45*a*. As the welding current is applied across the ends of the wire, shoulder 82 on slide 63 engages a lug 85 on slide 30 (FIG. 3). and urges the molten ends of the wire in engagement, and causes nose slide 30 to open limit switch LS2 in line L5. This cuts off the signal to and shuts down welder 118. Relay TA is also de-energized an interval of time after switch LS2 opens. After a brief time delay which permits the welded ends of the wire to cool, contact TA1 in line 117** opens. If desired, a jet of air may be blown on the weld at this time to enhance cooling.

As limit switch LS2 opens, slide 63 closes another limit switch LS3. Another timing relay TT is energized. The timing cycle of of relay TT determines the time of the weld integrity test. Relay TT is energized prior to relay TA timing out. Contacts TT1 and TT2 open to de-energize start relay ST, and solenoid S4, respectively. Solenoids S1 and S2 remain energized to keep the ends of the wire clamped. Contact TT3 retains the continuity of line 117 when contact TA1 opens.

When LS3 closes, solenoid S3 actuates valve 112 to cause cylinder 66 to attempt to retract slide 63; however, slide 63 engages latch pin 86 and attempts to move slide 30. Since the ends of the wire are still clamped, the weld is tensioned until relay TT times out. When this occurs, all TT relay contacts open and the network is de-energized except for solenoid S3. When solenoid S1 is de-energized, fluid is applied through port 89 to lift latch pin 86 and permit slide 63 to retract, at which time switch LS3 opens to de-energize solenoid S3.

If the weld should fail, slide 30 will open a normally closed switch 90 (FIG. 3), this will interrupt line 117, the cycle previously described, open the clamps, and allow cylinder 66 to retract slide 63. At this time, the machine can be made to repeat its cycle, thus applying a new band to replace the one that failed the test. The failed band may be removed if desired after other bands are applied, and the banded material is removed from the banding machine.

It will be understood that the system of FIG. 18 is merely exemplary. The system may be made to automatically repeat cycles at predetermined intervals as the articles to be banded are positioned for a new band.

It may thus be seen that the objects of the invention set forth as well as those made apparent from the foregoing description are efficiently attained. While preferred embodiments of the invention have been set forth for purposes of disclosure, modification to the disclosed embodiments of the invention as well as other embodiments thereof may occur to those skilled in the art. Accordingly, the appended claims are intended to cover all embodiments of the invention and modifications to the disclosed embodiments which do not depart from the spirit and scope of the invention.

What is claimed is:

1. A banding machine comprising a guideway for guiding banding wire about an object, means for feeding wire to said guideway, first clamping means, means responsive to the leading end of the wire encircling the object for holding the leading edge thereof in said first clamping means, means for reversing said feeding means and tensioning a length of wire about the object, second clamping means engaging the wire after tensioning thereof, means for severing the wire from the source adjacent said second clamping means and moving the ends toward each other, one of said clamping means having a hot welding electrode for contacting the wire adjacent one end of the wire, the other of said clamping means having a ground electrode for contacting the wire adjacent the other end thereof, means responsive to movement of the ends of the wire toward each other for contacting the severed wire behind the hot electrode to provide an electrical path to ground, said path to ground having a higher resistance than the resistance across the free ends during welding thereof.

2. The banding machine of claim 1 wherein said electrical contacting means contacts the wire between the hot electrode and the first point of contact of the wire with the object to be banded.

3. The machine of claim 1 further comprising a base member, first and second members on said base, said first member defining a first passage for wire therethrough from said feeding means, said second member defining a second passage therethrough past said second clamping means therein, said first member defining another passage past said first clamping means offset from said second passage, said second member being movable on said base to sever the wire and move the severed end toward the leading end in said first clamping means in the same motion, and means operated in timed relation with movement of said second member to sever the wire to bring said contacting means into contact with the wire.

4. The banding machine of claim 1 further including means for moving one of said clamping means to tension the weld prior to releasing said clamping means after said weld is cooled.

5. A banding machine comprising a guideway for guiding banding wire about an object, means for feeding wire to said guideway, first clamping means, means responive to the leading end of the wire encircling the object for holding the leading edge thereof in said first clamping means, means for reversing said feeding means and tensioning a length of wire about the object, second clamping means engaging the wire after tensioning thereof, means for severing the wire from the source adjacent said second clamping means and moving the ends toward each other, one of said clamping means having a hot welding electrode for contacting the wire adjacent one end of the wire, the other of said clamping means having a ground electrode for contacting the wire adjacent the other end thereof, said means for severing comprising a pivotal cutter on said second clamping means, and means for pivoting said cutter away from the area of weld after the wire is severed.

6. In a banding machine comprising a guideway for guiding banding wire about an object, means for feeding wire to said guideway, a first member having first clamping means, means responsive to the leading end of the wire encircling the object for holding the leading edge thereof and reversing said feeding means and tensioning a length of wire about the article, a second member having second clamping means engaging the wire after tensioning thereof, means for severing the wire from the source adjacent said second clamping means, means for moving said second member transversely of said wire toward the wire in said first clamping means, means for applying a welding current between the wire ends in said first and second clamping means, said second member carrying said severing means, and camming means for moving said cutter to a position away from the ends of said wire after severing thereof.

7. The machine of claim 6 wherein said severing means is pivotally mounted in said second member, and means on said first member for engaging said severing means and pivoting it away from the ends of the wire.

8. A banding machine comprising a guideway for guiding banding wire about an object, means for feeding wire from a source to said guideway, a first member having first clamping means, means responsive to the leading end of the wire encircling the object for holding the leading edge thereof and reversing said feeding means and tensioning a length of wire about the article, a second member having second clamping means engaging the wire after tensioning thereof, means for severing the wire from the source adjacent said second clamping means, means for welding the ends, and means for tensioning the banded wire across the weld to check the integrity of the weld after the weld has cooled.

9. The banding machine of claim 8 wherein said means for tensioning comprises means for moving said first clamping means with respect to said second clamping means.

* * * * *